United States Patent [19]

Nordmann

[11] Patent Number: 4,738,182

[45] Date of Patent: Apr. 19, 1988

[54] CARTRIDGE CASING EJECTOR

[76] Inventor: Adolf Nordmann, Isarstr. 73, 4006 Erkrath, Fed. Rep. of Germany

[21] Appl. No.: 673,354

[22] Filed: Nov. 20, 1984

[30] Foreign Application Priority Data

Dec. 1, 1983 [DE] Fed. Rep. of Germany ..... 3343522

[51] Int. Cl.[4] ..... F41C 9/22

[52] U.S. Cl. ..... 89/33.4; 89/45

[58] Field of Search ..... 89/33.4, 36.13, 36.14, 89/45, 46, 47

[56] References Cited

U.S. PATENT DOCUMENTS

| | | | |
|---|---|---|---|
| 2,779,243 | 1/1957 | Molins et al. | 89/33.4 |
| 2,851,928 | 9/1958 | Hultgren et al. | 89/45 |
| 2,956,480 | 10/1960 | Zouck | 89/33.4 |
| 3,136,212 | 6/1964 | Girouard et al. | 89/33.4 |
| 3,417,658 | 12/1968 | Betzold et al. | 89/33.4 |
| 4,495,853 | 1/1985 | Gottwaltd | 89/46 |

*Primary Examiner*—Harold D. Whitehead

[57] ABSTRACT

A casing ejector in an enclosed fighting compartment for ejecting stump casings of partially combusted cartridge casings.

For purposes of not hindering the loading process of an automatic loading mechanism, the cartridge casing ejecting mechanism includes a linkage of a plurality of holding arms which pivotally support a loading tray which is movable between a receiving position and expelling position. In the receiving position the tray receives the stump casing of a fired cartridge casing. The linkage of holding arms has one end of a cylinder-piston pivotally connected thereto while the other end is pivotally connected to a wall of the fighting compartment. This piston cylinder is adapted to move the tray in the linkage from the receiving position to the expelling position and vice versa. An expelling opening is provided in the fighting compartment opposite the loading tray in its expelling position. An endless chain is operatively mounted in the fighting compartment and has an entrainer for expelling the stump casing from the loading tray through the opening. When the loading tray is in the expelling position it is sufficiently distanced from the rear end of the gun barrel so that an automatic loading mechanism which is operatively mounted in the fighting compartment can effect a loading in an unhindered fashion.

4 Claims, 1 Drawing Sheet

CARTRIDGE CASING EJECTOR

BACKGROUND OF THE INVENTION

The invention relates to a casing ejector for ejecting stump casings and the like. Such casings are known and described in co-assigned U.S. Pat. No. 4,159,678. Stumps casings generally form part of a partially combustible propellant charge casing, which can be used in modern armored vehicle cannons, for example the 120 mm cannon of the Leopard II tank. While the major portion of the combustible propellant charge casing burns at firing jointly with the cartridge, the metallic portion forming the stump casing must be expelled from the loading chamber after the opening of the breech mechanism and must be removed without endangering the personnel firing the weapon.

A known solution for the operative problem described hereinabove is used in the Leopard II tank, wherein the stump casing which is pulled out of the gun barrel is caught in a casing box, arranged behind the gun barrel in the tank. This casing box prevents, however, the installation of an automatic loader.

SUMMARY OF THE INVENTION

It is a general object of this invention to provide a novel type of stump casing ejector which is capable of ejecting stump casings, pulled out of the gun barrel, in a secure and rapid manner from the chamber (fighting compartment in case of a tank) behind the gun barrel. Simultaneously, this novel arrangement is compact and requires only a limited amount of space so that an automatic loader can be built into the tank thereby increasing the combat capacity and combat readiness of the cannon.

BRIEF DESCRIPTION OF THE DRAWING

With these and other objects in view, which will become apparent in the following detailed description, the present invention, which is shown by example only, will be clearly understood in connection with the accompanying drawing, in which.

DETAILED DESCRIPTION

Figure 1:
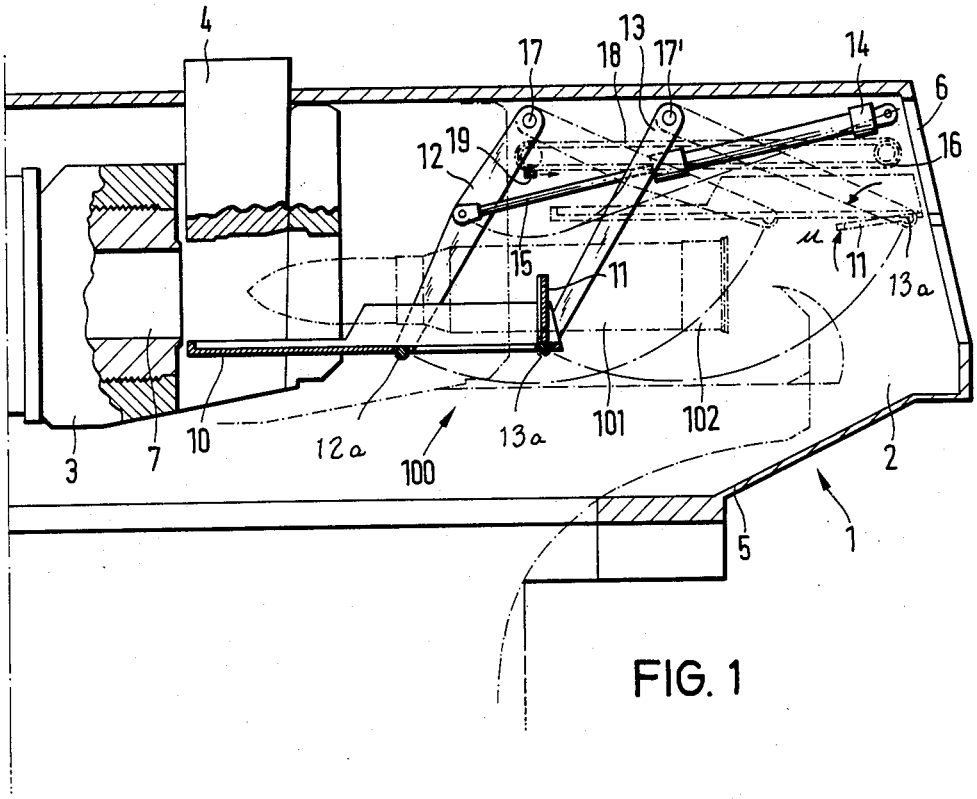
FIG. 1 is a longitudinal sectional view of the fighting compartment of a tank and the casing ejector arranged within this fighting compartment.
Figure 2:
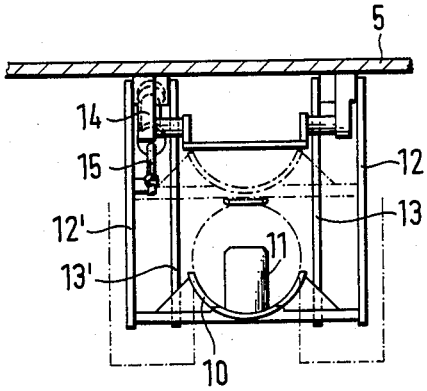
FIG. 2 is a front elevational view of the casing ejector as viewed away from the rear end of the gun barrel.

FIG. 1 illustrates in longitudinal section a portion of a fighting compartment 2 of a tank 1 also illustrating portions of the weapon installation and a casing ejector. The fighting compartment 2 is protected by means of armor plating 5. In the left portion of the figure there is illustrated a part of the gun barrel 3 of the tank 1 jointly with a breech mechanism 4 that is shown in the open position. The casing ejector 100 is swingably mounted to move between a receiving position and an expelling position. The receiving position of the casing ejector 100 is shown in solid lines, whereas the expelling position of the casing ejector 100 is shown in dash-dot lines. The casing ejector 100 includes a tray 10, which is arranged in the receiving position of the casing ejector 100 immediately behind the breech-confronting opening 7 of the gun barrel 3 and in this manner can catch the stump casing (which has not been illustrated in the drawing) which has been pulled out of the gun barrel 3. FIG. 2 illustrates in front elevation the casing ejector 100 as viewed away from the gun barrel rear end. It is particularly easy to recognize in this figure that the tray 10, consisting for example out of cylindrical parts, has a radius of curvature which corresponds to the periphery of the to be received stump casing. There are furthermore arranged a flap 11 in the tray 10 which flap is fixedly joined to holding arm 13, at a pivot point 13*a* at which the holding arm 13 is pivotally connected to the tray 10. Thereby the relative angular position of flap 11 and arm 13 remains constant. Similarly, the angle a between flap 11 and arm 13 remains constant during rotation of the axes 17, 17'. The tray 10 is, however, rotatable about the axes 12*a*, 13*a*. The surface of the tray 10 when in the receiving position of the cartridge ejector 100 is disposed in a vertically upwardly directed position. This flap 11 serves as a stop for the stump casings which are pulled out along the gun barrel axis of the gun barrel 3. The tray 10 is swingably connected to the end of a total of four holding arms 12, 12', 13, 13', whose other ends are rotatable about rigidly and fixedly mounted axes 17, 17' which are transversely mounted in the fighting compartment 2. A hydraulic driving unit consisting of cylinder 14 and piston 15, is, on the one hand, pivotally connected on one of the four holding arms 12, 12', 13, 13' in the interior of the fighting compartment 2. Such pivotal connections permit a swingable movement of the tray 10 from the receiving position into the expelling position, which, as has already been previously described, is illustrated in dot-dash lines in FIG. 1. In this expelling position the tray 10 is located in the plane above the receiving position opposite an opening 6 arranged in the armor plating 5 of the fighting compartment 2, by means of which the stump casing which is still disposed on the tray 10 can be expelled from the fighting compartment 2. It is to be noted that in this expelling position the flap 11 which acts in the receiving position as a stop for the stump casing has been folded inwardly into the contour of the tray 10 and does no longer block an expulsion of the stump casing through the opening 6. The means for expelling the stump casing through the opening 6 include a rotating endless chain 18, which includes at least one entraining member 19, which at rotation of the chain 18, removes and acceleratingly expels the stump casing disposed on the tray 10, so that it can be expelled through the opening 6 in the armor plating 5.

As can be clearly seen from FIG. 1, the cartridge ejector 100 is disposed in its expelling position so far above the longitudinal axis of the gun barrel 3, that the loading chamber is freely accessible and preferably can be reloaded by means of an automatic loader supplying a new cartridge. In view of the fact that the components of the automatic loader are not essential for an understanding of the invention, they have not been illustrated, while the dot-dash lined contour of a newly fed cartridge has been illustrated. This illustration suffices to show that the cartridge ejector 100, when in the expelling position, does not hinder the loading process. After loading of the cartridge 101 and the termination of the firing process the tray 10 is swingably returned to the receiving position and is again ready to receive a stump casing 102.

Although an embodiment of the invention has been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

I claim:

1. In a fighting compartment, an expelling mechanism for expelling stump casings of partially combusted propellant charge casing which have been fired from a cannon, wherein said expelling mechanism includes a loading tray which is operatively movable between a stump casing receiving position and a stump casing expelling position, and means operatively mounted in said fighting compartment for removing said stump casing from said loading tray when it is in its expelling position and expelling it from said fighting compartment via an opening thereof, including four holding arms being pivotally connected to said loading tray at one of their ends and being pivotally connected to a wall of said fighting compartment at another of their ends, hydraulic piston-cylinder means being pivotally connected to at least one of said four holding arms at one of its ends and being pivotally connected to a wall of said fighting compartment, whereby said hydraulic piston-cylinder means moves said loading tray via said holding arms from its receiving position to its expelling position and vice-versa.

2. In a fighting compartment, the expelling mechanism as set forth in claim 1, wherein said stump casing removing means includes an endless chain operatively mounted in said fighting compartment adjacent said loading tray when in its expelling position, and entraining means mounted on said endless chain for engaging a stump casing and expelling it via said opening in said fighting compartment.

3. In a fighting compartment, the expelling mechanism as set forth in claim 2, wherein said loading has a partially cylindrical shape whose diameter corresponds to that of the stump casing which is to be expelled.

4. In a fighting compartment, the expelling mechanism as set forth in claim 3, including a flap pivotally mounted at the end of the loading tray which is remote from said cannon, whereby when said loading tray is in the receiving position said flap extends normally from the cylindrical surface of the loading tray and serves as a stop for the stump casing which is being removed from the cannon, and when said loading tray is in the expelling position said flap is essentially folded into the plane of the loading tray so as not to hinder the expulsion of the stump casing from the fighting compartment.

* * * * *